US005607618A

United States Patent [19]

Antwerpen et al.

[11] Patent Number: 5,607,618

[45] Date of Patent: Mar. 4, 1997

[54] USE OF A WATER-SOLUBLE COPOLYMERS BASED ON ACRYLAMIDOALKYLENESULFONIC ACID AS A DETERGENT ADDITIVE

[75] Inventors: Werner Antwerpen, Schwalbach/Ts; Martin Hille, Liederbach; Gerd Reinhardt, Kelkheim, all of Germany

[73] Assignee: Hoechst Aktiengesellschaft, Germany

[21] Appl. No.: 109,229

[22] Filed: Aug. 19, 1993

[30] Foreign Application Priority Data

Aug. 22, 1992 [DE] Germany ..... 42 27 912.7

[51] Int. Cl.[6] ..... C11D 1/18

[52] U.S. Cl. ..... 510/302; 252/542; 252/545; 252/547; 252/550; 252/552; 510/307; 510/320; 510/350; 510/351; 510/357

[58] Field of Search ..... 252/174.23, 542, 252/545, 547, 550, 552

[56] References Cited

U.S. PATENT DOCUMENTS

| | | | |
|---|---|---|---|
| 3,925,262 | 12/1975 | Laughlin et al. | 252/526 |
| 3,929,678 | 12/1975 | Laughlin et al. | 252/526 |
| 5,126,069 | 6/1992 | Kud et al. | 252/174.23 |
| 5,207,941 | 5/1993 | Kroner et al. | 252/174.23 |
| 5,399,616 | 3/1995 | Kuhn et al. | 524/765 |

FOREIGN PATENT DOCUMENTS

| | | |
|---|---|---|
| 994635 | 8/1976 | Canada . |
| 1241497 | 8/1988 | Canada . |
| 2067748 | 4/1991 | Canada . |
| 0113048 | 7/1984 | European Pat. Off. . |
| 0506613 | 9/1992 | European Pat. Off. . |
| 3711299 | 10/1988 | Germany . |
| 3803630 | 8/1989 | Germany . |
| 4-153330 | 5/1992 | Japan . |

*Primary Examiner*—Brian M. Burn
*Attorney, Agent, or Firm*—Connolly & Hutz

[57] ABSTRACT

The present invention relates to the the use of water-soluble copolymers based on acrylamidoalkylenesulfonic acid, vinylacetamide and, if appropriate, other monomers, comprising 5–90% by weight of structural units of the formula

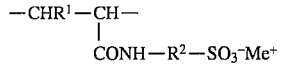

(I)

in which $R^1$ is hydrogen or methyl, $R^2$ is $C_2$–$C_{10}$-alkylene, preferably $C_2$–$C_6$-alkylene, particularly preferably $C_4$-alkylene, and Me is ammonium or an alkali metal ion, 5–95% by weight of structural units of the formula

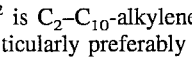

(II)

in which $R^3$ and $R^4$ independently of one another are hydrogen, methyl or ethyl, or $R^3$ and $R^4$ together are a propylene group which, including a radical

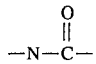

form a pyrrolidone radical,

0–90% by weight of structural units of the formula

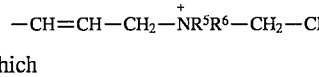

(III)

in which

X is a halogen, preferably chloride, $R^5$ and $R^6$ independently of one another are $C_1$–$C_6$-alkyl, prefrably $C_1$–$C_3$-alkyl, in particular methyl or ethyl, and 0–90% by weight of structural units of the formula —$CHR^7$-$CHR^8$— in which $R^7$ is hydrogen or methyl and $R^8$ is $CONH_2$, $CON(CH_3)_2$, cyano, $SO_3H$, $SO_3Me$, $C_6H_4SO_3H$, $C_6H_4SO_3Me$, $CH_2SO_3H$, $CH_2SO_3Mr$, COOH, COOMe or an ester group COOR, in which R is $C_1$–$C_{15}$-alkyl, preferably $C_1$–$C_8$-alkyl, as a detergent additive for preventing reabsorption of detached dyestuffs and dyestuff degradation products.

17 Claims, No Drawings

USE OF A WATER-SOLUBLE COPOLYMERS BASED ON ACRYLAMIDOALKYLENESULFONIC ACID AS A DETERGENT ADDITIVE

The laundry washed nowadays in the home and industry comprises uniform or, especially in the home, mostly different types of fiber, in particular naturally occurring fibers, chiefly cotton and wool, regenerated cellulose fibers, for example viscose, synthetic fibers, for example polyester, polyamide and polyacrylonitrile, and blends of such fibers. In contrast to the so-called "white wash" which comprises undyed textiles, the so-called "colored wash" comprises dyed textiles usually in different color shades and depths of color, from pale or pastel to dark. It goes without saying that textiles having widely different color-fastnesses can be present in a washing operation of a domestic colored wash. If the dyeings are not sufficiently fast to washing in this case, dyestuffs or dyestuff degradation products detach during the washing process and bleed off into the wash liquor. Reabsorption of these detached (bled-off) constituents onto the other textiles washed at the same time results in "staining", a shift in shade and/or the formation of specks due to reabsorbed dyestuff or dyestuff degradation products which have bled off and are possibly non-uniformly distributed. The detaching and/or decomposition of dyestuff from an inadequately fast dyeing is favored, for example, by higher temperatures, repeated washing operations, the liquor ratio of wash liquor to laundry, the composition of detergent employed and its concentration in the wash liquor, and the type of washing machine and washing program used can also have an influence on the detaching of dyestuff or dyestuff degradation products from a dyeing which is not sufficiently "appropriate for domestic washes", for example due to the mechanical stress on the laundry during washing and the like. Other reasons which can be mentioned for a drop in fastness are also the quality of the water used (for example due to the chlorine content), the composition of certain additives for easy-care handling and the quality and structure of the textile material or fibers. An example which may be mentioned for this is laundry of cellulose fibers, above all cotton; this is usually dyed with direct dyestuffs, reactive dyestuffs, sulfur dyestuffs, vat dyestuffs or naphthol dyestuffs, mainly with direct dyestuffs or reactive dyestuffs. Both dyeings with direct dyestuffs and dyeings with reactive dyestuffs on cellulose tend to "bleed off" into the wash liquors to a greater or lesser degree during repeated washing—and the wash liquors consequently contain, for example, non-fixed dyestuff, hydrolyzed dyestuff and/or dyestuff which has been split off—leading to the problems described above.

The color transfer reaction is often divided into two part steps:

detaching of the dyestuff particles from the textile fiber redeposition elsewhere on the laundry.

Various proposals are described in the literature to prevent this reaction.

On the one hand, it is possible to destroy the dyestuff by oxidation while it is present in the wash liquor in dissolved form. This presents no problem if conventional heavy-duty detergents are used, since these usually comprise a bleaching system of perborate and a persalt activator, such as tetracetylethylenediamine, TAED. The peracetic acid formed therefrom destroys the dissolved dyestuffs completely before absorption onto the fiber is possible. A disadvantage here is, however, that color damage due to bleaching of the textile colors can also occur in the case of reactive perborate activators.

In addition to bleaching activators, enzymes having peroxidase properties are also suitable for these applications (CA-A-2 067 748).

Another possibility for preventing color transfer is incorporation of polymeric color transfer inhibitors into the detergent formulation. In this case, the dissolved dyestuff particles are complexed and stabilized by the polymer in the wash liquor and reabsorption onto the fiber is thus prevented.

Homopolymers of vinylimidazole and vinylpyrrolidone are employed as preferred inhibitors. CA-A-0 094 635 describes detergent formulations having reduced color transfer during the washing operation which comprise polyvinylpyrrolidone (PVP).

Detergent additives for avoiding color transfer during washing which comprise polymers based on N-vinylpyrrolidone, N-vinylimidazole or N-vinyloxazolidone are known from DE-A-38 03 630.

DE-A-37 11 299 discloses polyvinylpyrrolidones grafted with vinyl esters as graying inhibitors for textiles comprising synthetic fibers.

A disadvantage of these polymeric color transfer inhibitors is their often low solubility, especially in the case of modified polyvinylpyrrolidones, which makes incorporation into liquid detergent formulations difficult.

The invention relates to the use of water-soluble copolymers based on acrylamidoalkylenesulfonic acids, vinylacetamide and if appropriate other monomers, comprising 5–90% by weight of structural units of the formula

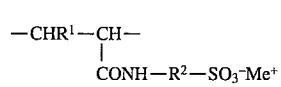

(I)

in which $R^1$ is hydrogen or methyl, $R^2$ is $C_2$–$C_{10}$-alkylene, preferably $C_2$–$C_6$-alkylene, particularly preferably $C_4$-alkylene, and Me is ammonium or an alkali metal ion, 5–95% by weight of structural units of the formula

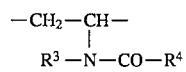

(II)

in which $R^3$ and $R^4$ independently of one another are hydrogen, methyl or ethyl, or $R^3$ and $R^4$ together are a propylene group which, including a radical

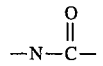

form a pyrrolidone radical, 0–90% by weight of structural units of the formula

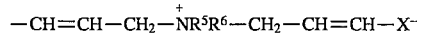

(III)

in which

X is a halogen, preferably chloride, $R^5$ and $R^6$ independently of one another are $C_1$–$C_6$-alkyl, preferably $C_1$–$C_3$-alkyl, in particular methyl or ethyl, and 0–90% by weight of structural units of the formula

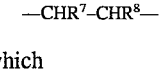

in which $R^7$ is hydrogen or methyl and $R^8$ is $CONH_2$, $CON(CH_3)_2$, cyano, $SO_3H$, $SO_3Mc$, $C_6H_4SO_3H$, $C_6H_4SO_3Mc$, $CH_2SO_3H$, $CH_2SO_3Mr$, COOH, COOMe or an ester group COOR, in which R is $C_1$–$C_{15}$-alkyl, preferably $C_1$–$C_8$-alkyl, as a detergent additive for preventing reabsorption of detached dyestuffs and dyestuff degradation products.

Preferred water-soluble copolymers comprise

40–90% by weight of structural units of the formula (I),

10–60% by weight of structural units of the formula (II) and

0–40% by weight of structural units of the formula (III).

Suitable copolymers contain the monomers 2-acrylamido-2-methylpropanesulfonic acid (AMPS), diallyldimethylammonium chloride (DADMAC), N-vinyl-N-methylacetamide (VIMA), N-vinylpyrrolidone (VIPY), acrylamide (AM), vinylacetamide (VA) and vinylformamide (VF).

Examples are copolymers with 40–70% by weight of 2-acrylamido-2-methylpropane-3-sulfonic acid, 10–30% by weight of vinylacetamide and 0–60% by weight of acrylamide or 5–60% by weight of 2-acrylamido-2-methylpropanesulfonic acid or vinylsulfonic acid, 2–20% by weight of vinylacetamide and 45–90% by weight of acrylamide.

The weight-average molecular weights $\overline{M}_w$ of the copolymers employed are 50,000 to $20 \cdot 10^6$. The molecular weights $\overline{M}_w$ for copolymers of low molecular weight are in the range between 50,000 and $3 \cdot 10^6$, preferably 200,000–$10^6$. Copolymers of high molecular weights have molecular weights $\overline{M}_w$ in the range from more than $3 \cdot 10^6$ to $20 \cdot 10^6$.

Among the copolymers described above, copolymers which are obtainable under the trade names ®Hostamar and ®Hostadrill (Hoechst AG, DE) are preferably used.

The detergents can be either industrial detergents or domestic detergents. These include, in particular, pulverulent and liquid heavy-duty detergents, pulverulent and liquid mild washing agents, machine dishwashing agent boosters, such as scouring salts and pastes, and after-treatment agents for washing (shaping rinses and softeners). The most important components of the detergents are the wash-active surfactants, which are chiefly (a) anionic, nonionic and/or zwitterionic wash-active surfactants.

The anionic wash-active surfactants are chiefly sulfonates, such as alkylarylsulfonates, for example dodecylbenzenesulfonate, alkylsulfonates and alkenylsulfonates, and sulfates, for example alkyl sulfates, sulfates of ethoxylated amides, esters of α-sulfofatty acids or also soaps of naturally occurring, optionally modified or synthetic fatty acids, the anionic surfactants advantageously being in salt form, for example as an alkali metal salt (sodium or potassium), as an ammonium salt or as a salt of organic bases, in particular monoethanolamine, diethanolamine or triethanolamine salts. The anionic surfactants furthermore include sulfosuccinates, alkyl ether-sulfates, alkyl ether-carboxylates and fatty acid condensation products, such as are usually used in washing and cleaning formulations.

Possible nonionic wash-active surfactants are chiefly polyethylene glycol ethers of higher alcohols or alkylphenols, polyethylene glycol esters of fatty acids and polyoxyethylation products of fatty acid amides. The fatty radicals or alkyl and alkylene radicals in the abovementioned surfactants or alcohols or fatty acids contain, for example, 8–20 carbon atoms; aryl is chiefly phenyl; the polyethylene glycol chains can contain, for example, 3–80 ethyleneoxy groups and can optionally comprise propyleneoxy units. Typical nonionic surfactants are alkyl polyethoxylates, alkyl polyglycosides, glucamides, alkylamine N-oxides, alkylphosphine oxides and condensation products of fatty alcohols with ethylene oxide and propylene oxide.

Surfactants which are preferred as (a) are, among the anionic surfactants, the alkylbenzenesulfonates, the alkanesulfonates, the alkylsulfonates and the soaps and, among the nonionic surfactants, the alkyl polyglycol ethers.

Examples of zwitterionic surfactants are derivatives of aliphatic quaternary ammonium, phosphonium and sulfonium compounds, such as are known from U.S. Pat. No. 3,925,262 and U.S. Pat. No. 3,929,678.

Depending on the field of use and the intended use of the detergents, these can comprise, for example, components (a), as described above, by themselves (for example for industrial purposes), or can also comprise one or more further additives (for example also for industrial purposes or, in particular, for domestic detergents), in which case the following additives essentially can be mentioned:

(b) sequestering agents (c) enzymes (d) bleaching agents—if appropriate together with customary bleaching additives, in particular ($d_1$) activators and/or ($d_2$) stabilizers (e) washing alkalis (f) anti-redeposition agents.

Sequestering agents (b) which may be mentioned are the customary complexing substances, for example aminopolyacetates (in particular nitrilotriacetate or ethylenediaminetetraacetate), aminopolymethylene phosphates, sodium triphosphate, sodium tripolyphosphates, sodium aluminium silicates, sodium silicate, magnesium silicate, zeolite A, polyacrylates (for example ammonium polyacrylates), poly-α-hydroxyacrylates and salts of hydroxycarboxylic acids (for example sodium citrate, sodium tartrate and sodium gluconate).

Enzymes (c) which may be mentioned are, for example, the customary proteases, lipases and amylases.

Bleaching agents (d) which may be mentioned are the customary peroxy compounds, for example perborates, percarbonates, perphosphates or peroxides, in particular in the form of alkali metal salts, or, especially in liquid formulations, also hydrogen peroxide. Possible stabilizers for the percompounds can be, for example, the abovementioned sequestering agents, and the customary carboxylic acids or amido derivatives may be mentioned as activators which may be present.

The customary bases can be used as the wash alkalis (e), for example ammonium or alkali metal silicates, phosphates, carbonates, borates or hydroxides; the particular alkali percompounds above can also act as wash alkalis, where appropriate.

Possible anti-redeposition agents (f) which may be present are the customary substances, in particular benzotriazoles, ethylenethiourea, cellulose ethers (for example carboxymethylcellulose) or polyvinylpyrrolidones.

If appropriate, the detergents can also contain other additives, for example defoamers (or foam stabilizers), fragrances, disinfectants, buffer salts, compounds which release active chlorine, corrosion inhibitors, solvents, solubilizing agents, treatment or carrier substances, preservatives and other electrolytes (for example sodium sulfate).

The compositions of the detergents can vary widely in amounts, depending on the manufacturer and specified use.

The polyvinyl alcohols used according to the invention can be added to the wash liquors individually or, if desired, can be incorporated into the detergents.

Washing is carried out chiefly under weakly acid to significantly basic conditions, advantageously at pH values in the range from 6 to 12, preferably 7 to 10. The additives according to the invention are advantageously employed in concentrations of 0.05 to 10 g/l, preferably 0.5 to 4 g/l of aqueous wash liquor. The content of these compounds in the detergent formulation is advantageously in the range from 0.2 to 10% by weight, preferably 1 to 6% by weight.

Washing can be carried out under customary conditions and as intended in the particular washing programs of commercially available washing machines, advantageously in a total washing process, in which all the constituents are present in the liquor and are preferably added. The washing temperature can likewise vary within the customary ranges, for example in the range from 15° to 95° C., the temperatures for colored washes, which are generally customary nowadays, in the range from 30° to 60° C. being preferred here.

Any desired materials can be washed, such as are envisaged in industry and the home for the particular washing operations, for example loose fibers, filaments, threads, spools, woven fabric, knitted fabric, non-wovens, open webs, tubular goods, velvet, felt, tufting goods, carpets, structured porous plastic materials similar to fabric (such as are used for the home and clothing) and, in particular, semi-finished and finished goods. The substrates can comprise any desired customary materials, for example naturally occurring or regenerated cellulose (for example cotton, linen, hemp, viscose), naturally occurring polyamides (for example wool, silk) or synthetic materials (for example polyamides, polyesters, polyacrylonitriles, polypropylene or polyurethanes), and mixtures thereof. The cellulose-containing substrates are to be singled out in particular, and above all colored laundry which contains dyed cellulose substrates.

The detergent additives according to the invention are readily compatible with the customary detergents, such as those listed above, and hardly impair their washing action, and may even assist them. They prevent reabsorption of bled-off dyestuffs and dyestuff degradation products onto the washed material, especially onto the material washed at the same time, surprisingly well and can be rinsed out of the washed material analogously to the other wash liquor components. They do not attack the laundry. Compared with the known polymeric color transfer inhibitors, they are distinguished by a usually superior performance. Because of their good water-solubility, they can be incorporated into liquid washing and cleaning formulations without problems.

EXAMPLES

Washing experiments in a launder-o-meter

The washing experiments were carried out in a launder-o-meter at 40° C. The washing time was 20 minutes, the detergent concentration was 4 g/l of WMP test detergent (Wäschereiforschung Krefeld) and the water hardness was 16° dH.

1.25 g of cotton fabric dyed with ®Diamin-Braun BR (registered trade mark of Hoechst AG, Frankfurt) were washed together with 5 g of white cotton fabric in 400 ml of wash liquor.

In each case 1% by weight (based on the test detergent) of the color transfer inhibitors according to the invention was added to the wash liquor and the whiteness of the white fabric was determined after the washing process by reflectance measurement. 1.3% by weight of polyvinylpyrrolidone, based on the test detergent, was employed as the comparison substance. The pure WMP test detergent was tested without additive in another comparison experiment.

| Compound | Reflectance of the white fabric after washing |
|---|---|
| ® Hostadrill 3118 | 59.9% |
| ® Hostadrill 2825 | 60.8% |
| ® Dispersant M | 60.2% |
| ® Hostamer 3212 | 65.4% |
| Comparison | |
| Polyvinylpyrrolidone | 56.1% |
| without additive | 55.2% |

We claim:

1. A detergent composition containing a wash-active surfactant and an additive for preventing the readsorbation of dyestuffs and dyestuff degradation products consisting essentially of a water-soluble copolymer consisting of 5–90% by weight of structural units of the formula

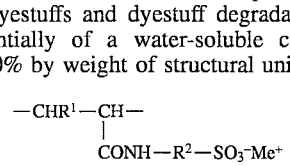

(I)

in which $R^1$ is hydrogen or methyl, $R^2$ is $C_2$–$C_{10}$-alkylene, and

Me is ammonium or an alkali metal ion,

5–95% by weight of structural units of the formula

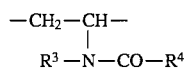

(II)

in which $R^3$ and $R^4$ independently of one another are hydrogen, methyl or ethyl, or $R^3$ and $R^4$ together are a propylene group which, including a radical

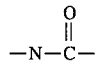

form a pyrrolidone radical,

0–90% by weight of structural units of the formula

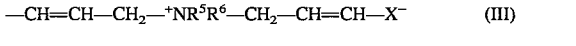

(III)

in which

X is a halogen, $R^5$ and $R^6$ independently of one another are $C_1$–$C_6$-alkyl, and 0–90% by weight of structural units of the formula

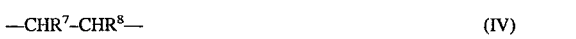

(IV)

in which $R^7$ is hydrogen or methyl and $R^8$ is $CONH_2$, $CON(CH_3)_2$, cyano, $SO_3H$, $SO_3Me$, $C_6H_4SO_3H$, $C_6H_4SO_3Me$, $CH_2SO_3H$ or $CH_2SO_3Me$.

2. A detergent composition as claimed in claim 1, wherein a component imparting detergent properties to said composition selected from the group consisting of an anionic, nonionic and zwitterionic surfactant, and mixtures thereof.

3. A detergent composition containing an additive for preventing readsorbation of detached dyestuffs and dyestuff degradation products, as claimed in claim 2 wherein in said copolymer $R^2$ is $C_2$–$C_6$-alkene, X is chloride, $R^5$ and $R^6$ independently of one another are $C_1$–$C_3$-alkyl, and R is $C_1$–$C_8$-alkyl.

4. A detergent composition containing an additive for preventing readsorbation of detached dyestuffs and dyestuff degradation products, as claimed in claim 2 wherein, in said copolymer $R^2$ is $C_4$-alkylene, and $R^5$ and $R^6$ independently of one another are methyl or ethyl.

5. A detergent composition containing an additive for preventing readsorbation of detached dyestuffs and dyestuff degradation products, as claimed in claim 2, wherein the copolymer employed comprises 40–90% by weight of structural units of the formula (I), 10–60% by weight of structural units of the formula (II) and 0–40% by weight of structural units of the formula (III).

6. A detergent composition containing an additive for preventing readsorbation of detached dyestuffs and dyestuff degradation products, as claimed in claim 2, wherein the copolymer employed comprises 40–70% by weight of 2-acrylamido-2-methyl-propane-sulfonic acid or vinylsulfinic acid, 2–20% by weight of vinylacetamide and 45–90% by weight of acrylamide.

7. A detergent composition containing an additive for preventing readsorbation of detached dyestuffs and dyestuff degradation products, as claimed in claim 2, wherein said copolymer has molecular weight ($M_w$) of 50,000 to $20 \cdot 10^6$.

8. A detergent as claimed in claim 2, wherein said detergent composition is a textile detergent, detergent compositions booster and/or aftertreatment agent for washing.

9. A detergent composition as claimed in claim 2, wherein said detergent composition is an industrial detergent.

10. A detergent composition as claimed in claim 2, wherein said detergent composition is a domestic detergent.

11. A detergent composition as claimed in claim 1, said composition comprising:

an anionic, nonionic or zwitterionic surfactant, a said water-soluble copolymer, and at least one of the following additional components:

a. a sequestering agent, b. an optical brightener, c. an enzyme, d. a bleaching agent, e. a stabilizing or activating agent for said bleaching agent or a combination of a stabilizing agent and an activating agent, f. a washing alkali, g. an anti-redeposition agent.

12. A washing bath comprising an aqueous wash liquor containing 0.2 to 10% by weight of the detergent composition of claim 1.

13. A washing bath comprising an aqueous wash liquor containing 0.2 to 10% by weight of the detergent composition of claim 11.

14. A method for preventing readsorption of detached dyestuffs and dyestuff degradation products, during washing with a detergent composition, comprising the step of adding to said detergent composition a water-soluble copolymer consisting of:

5–90% by weight of structural units of the formula

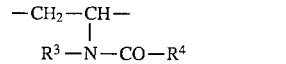

(I)

in which $R^1$ is hydrogen or methyl, $R^2$ is $C_2$–$C_{10}$-alkylene, and

Me is ammonium or an alkali metal ion,

5–95% by weight of structural units of the formula

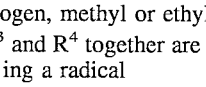

(II)

in which $R^3$ and $R^4$ independently of one another are hydrogen, methyl or ethyl, or $R^3$ and $R^4$ together are a propylene group which, including a radical

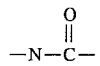

form a pyrrolidone radical,

0–90% by weight of structural units of the formula

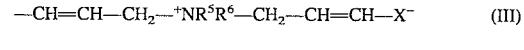

(III)

in which

X is a halogen, $R^5$ and $R^6$ independently of one another are $C_1$–$C_6$-alkyl, and 0–90% by weight of structural units of the formula

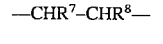

(IV)

in which $R^7$ is hydrogen or methyl and $R^8$ is $CONH_2$, $CON(CH_3)_2$, cyano, $SO_3H$, $SO_3Me$, $C_6H_4SO_3H$, $C_6H_4SO_3Me$, $CH_2SO_3H$ or $CH_2SO_3Me$.

15. A detergent composition containing a wash-active surfactant and an additive for preventing the readsorbation of dyestuffs and dyestuff degradation products comprising a water-soluble copolymer comprising structural units of the formula (I)

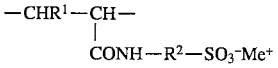

(I)

in which $R^1$ is hydrogen or methyl, $R^2$ is $C_2$–$C_{10}$-alkylene, and

Me is ammonium or an alkali metal ion, structural units of the formula (II)

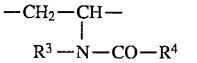

(II)

in which $R^3$ and $R^4$ independently of one another are hydrogen, methyl or ethyl, or $R^3$ and $R^4$ together are a propylene group which, including a radical

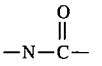

form a pyrrolidone radical, and structural units of the formula (III)

$$-CH{=}CH-CH_2-{}^{+}NR^5R^6-CH_2-CH{=}CH-X^- \quad (III)$$

in which

X is a halogen, $R^5$ and $R^6$ independently of one another are $C_1$–$C_6$-alkyl.

16. A detergent composition as claimed in claim 15, further comprising structural units of formula IV $$-CHR^7-CHR^8- \quad (IV)$$

in which $R^7$ is hydrogen or methyl and $R^8$ is $CONH_2$, $CON(CH_3)_2$, cyano, $SO_3H$, $SO_3Me$, $C_6H_4SO_3H$, $C_6H_4SO_3Me$, $CH_2SO_3H$, $CH_2SO_3Me$, COOH, COOMe or an ester group COOR, in which R is $C_1$–$C_{15}$-alkyl.

17. A detergent composition containing a wash-active surfactant and an additive for preventing the readsorbation of dyestuffs and dyestuff degradation products comprising a water-soluble copolymer comprising 5–90% by weight of structural units of the formula (I)

$$\begin{array}{l} -CHR^1-CH- \\ \qquad\quad\ \ | \\ \qquad\quad CONH-R^2-SO_3^-Me^+ \end{array} \quad (I)$$

in which $R^1$ is hydrogen or methyl, $R^2$ is $C_2$–$C_{10}$-alkylene, and

Me is ammonium or an alkali metal ion,

5–95% by weight of the structural units of the formula (II)

$$\begin{array}{l} -CH_2-CH- \\ \qquad\quad\ \ | \\ \quad R^3-N-CO-R^4 \end{array} \quad (II)$$

in which $R^3$ and $R^4$ independently of one another are hydrogen, methyl or ethyl, or $R^3$ and $R^4$ together are a propylene group which, including a radical $$\begin{array}{l} \quad\ \ O \\ \quad\ \ \| \\ -N-C- \end{array}$$

form a pyrrolidone radical, and structural units of formula (III) to be present in an amount up to 90% by weight $$-CH{=}CH-CH_2-{}^{+}NR^5R^6-CH_2-CH{=}CH-X^- \quad (III)$$

in which

X is a halogen, $R^5$ and $R^6$ independently of one another are $C_1$–$C_6$-alkyl.

* * * * *